US008731223B2

(12) United States Patent
Seo et al.

(10) Patent No.: US 8,731,223 B2
(45) Date of Patent: May 20, 2014

(54) MICROSPEAKER WITH INNER RESONANCE CHAMBER

(71) Applicant: Bujeon Co., Ltd., Ansan (KR)

(72) Inventors: Dong Hyun Seo, Ansan (KR); Seung Cheol Lee, Seoul (KR)

(73) Assignee: Bujeon Co., Ltd., Ansan (KR)

( * ) Notice: Subject to any disclaimer, the term of this patent is extended or adjusted under 35 U.S.C. 154(b) by 0 days.

(21) Appl. No.: 13/713,613

(22) Filed: Dec. 13, 2012

(65) Prior Publication Data

US 2013/0148834 A1 Jun. 13, 2013

(30) Foreign Application Priority Data

Dec. 13, 2011 (KR) ..... 10-2011-0133599
Dec. 10, 2012 (KR) ..... 10-2012-0142571

(51) Int. Cl.
*H04R 9/02* (2006.01)

(52) U.S. Cl.
CPC ..... *H04R 9/027* (2013.01)
USPC ..... 381/338; 381/349; 381/412

(58) Field of Classification Search
USPC ..... 381/345, 349–353, 386–392, 396, 400, 381/412; 181/148, 153, 182, 198, 199
See application file for complete search history.

(56) References Cited

U.S. PATENT DOCUMENTS

| | | | | |
|---|---|---|---|---|
| 6,487,300 | B1 * | 11/2002 | Lee et al. | 381/396 |
| 2002/0153193 | A1 * | 10/2002 | Toki | 181/148 |
| 2005/0190941 | A1 * | 9/2005 | Yang | 381/351 |
| 2008/0240486 | A1 * | 10/2008 | Garcia et al. | 381/380 |
| 2009/0304221 | A1 * | 12/2009 | Lin | 381/386 |

FOREIGN PATENT DOCUMENTS

KR 1020070021014 A 2/2007

* cited by examiner

*Primary Examiner* — Tuan D Nguyen
(74) *Attorney, Agent, or Firm* — Novick, Kim & Lee, PLLC; Jae Youn Kim

(57) ABSTRACT

Disclosed is a microspeaker with an inner resonance chamber, more particularly a microspeaker with an inner resonance chamber which improves quality of sound and enables slim and compact design of the microspeaker by blocking rearward sound generated at the rear side of the vibration plate to prevent interference of a rearward sound with a forward sound generated at the front side of a vibration plate and installing a chamber with a specific volume within the microspeaker to allow the rearward sound to cause resonance.

12 Claims, 9 Drawing Sheets

MICROSPEAKER WITH INNER RESONANCE CHAMBER

BACKGROUND OF THE INVENTION

1. Field of the Invention

The present invention relates to a microspeaker with an inner resonance chamber, and more particularly to a microspeaker with an inner resonance chamber which improves quality of sound and enables slim and compact design of the microspeaker by blocking rearward sound generated at the read side of the vibration plate to prevent interference of a rearward sound with a forward sound generated at the front side of a vibration plate and installing a chamber with a specific volume within the microspeaker to allow the rearward sound to cause resonance.

2. Description of the Related Art

In general, portable electronic devices including portable communication terminals, laptop computers, and MP3 players are provided with a microspeaker for converting an electric signal into an acoustic signal. Such a microspeaker converts electrical energy into mechanical energy by positioning a voice coil in an air gap of the magnetic circuit, according to Fleming's left-hand rule, which states that when a coil of wire carrying an electric current is placed in a magnetic field, the coil is caused to move.

The microspeaker includes a magnet, an upper plate, and a yoke member to configure a magnetic circuit, and a voice coil is installed in the air gap to interlink with the magnetic flux of the magnetic circuit. The voice coil is adhered to the lower surface of a vibration plate which is adhesively bound at its edges by a frame, so that and attractive and repulsive forces may be generated between an electromotive force generated by an input signal applied to the voice coil and the magnetic circuit to cause the vibration plate to vibrate to generate sounds.

As the vibration plate vibrates back and forth as above, forward sound is generated at the front side of the vibration plate, while rearward sound is generated at the rear side of the vibration plate. The forward sound generated at the front side of the vibration plate is radiated forward through a forward sound emitting outlet provided at the front side of the microspeaker, and the rearward sound generated at the rear side of the vibration plate is discharged rearward through a rearward sound emitting outlet provided at the rear side of the microspeaker. The present invention is directed to processing rearward sound generated at the rear side of the vibration plate. That is, since the forward sound radiated forward from the front side of the vibration plate has a phase difference of 180° from the rearward sound radiated rearward from the rear side of the vibration plate, interference may occur when the forward sound meets the rearward sound in a narrow space, resulting in degradation of quality of low frequency sounds. Therefore, if the rearward sound generated at the rear side of the vibration plate is not blocked, low frequency sounds undergo destructive interference, and only high frequency sounds remain, thereby making it difficult to reproduce natural sounds.

Accordingly, the present invention is directed to blocking rearward sounds generated at the rear side of the vibration plate from interfering with forward sounds generated at the front side of the vibration plate. Conventionally, an enclosure has been used to block the rearward sound generated at the rear side of the vibration plate. The enclosure accommodates the microspeaker to serve to block the rearward sound generated at the rear side of the vibration plate. Here, if the rearward sound generated at the rear side of the vibration plate is completely blocked, air pressure at the rear side of the vibration plate rises to cause a narrow amplitude and shift of the sound to a higher frequency range, leading to degradation of sound quality. To address this problem, a chamber (back volume) having a certain size has conventionally been installed in the enclosure to damp the rearward sound generated at the rear side of the vibration plate to improve the characteristics of low frequency sounds. In improving the characteristics of the low frequency range, a back volume having a large size is more advantageous. Thus, in the conventional cases, a back volume having an adequate size has been formed between the microspeaker and the enclosure. However, as the size of the enclosure increases due to the back volume, there is a problem of causing the microspeaker module to be thicker. In the field of the present invention in which slim and compact designs are pursued, a thinner microspeaker is advantageous. Accordingly, there is a need to limit the volumetric size of the back volume to reduce the thickness of the microspeaker module.

Meanwhile, for a microspeaker used for an in-ear earphone, interference between the forward sound and the rearward sound rarely occurs, but if a rearward sound is not blocked, a shrill sound (a hissing sound) is caused by a resonance occurring in the outer ear, and the sound is shifted to the high frequency range, and thereby there is a problem of degradation of the sound quality. Therefore, there is a need to improve the quality of sound through adjustment to an even balance in the high frequency range by increasing sound pressure to allow the rearward sound generated at the rear side of the vibration plate to cause resonance and at the same time to shift the resonant frequency in the high frequency range to a lower frequency range.

For example, as shown in FIG. 15, a conventional speaker module 220 (Korean Patent Application Publication No. 10-2007-0021014) defines a back volume S20 of a predetermined size at the rear side of the spear unit 224 to block the rearward sound to improve the characteristics of the low frequency sounds. However, in case of the conventional back volume S20, a cable 226 installed separately at the outside of a speaker unit 224 and connected to the speaker unit 224 is positioned in the back volume S20. In addition, solder is formed in the back volume S20 to fix the cable 226 to a connection terminal of the speaker unit 224.

Thereby, the space of the conventional back volume S20 is reduced by the cable 226 and the solder. In particular, for a subminiature microspeaker like an in-ear earphone, a space available for installation of the back volume is limited, and therefore reduction of the space due to the cable and the solder has a considerable effect on the microspeaker. Further, for the conventional microspeakers, since the sizes of the cable and the solder located in the back volume are uncontrollable, the back volume varies from one product to another. Accordingly, it is difficult to make the rearward sound cause resonance with a conventional microspeaker. That is, for the rearward sound to cause resonance, the natural frequency of the vibration plate should coincide with that of the back volume. But in conventional microspeakers, the size of the back volume cannot be precisely controlled, and thus acoustic resonance cannot be caused. Accordingly, the back volume of a conventional microspeaker, which has been used to improve characteristics of low frequency sounds, has a problem of failing to effectively control the shrill sound in the high frequency range.

SUMMARY OF THE INVENTION

Therefore, the present invention has been made in view of the above problems, and it is an object of the present invention to provide a microspeaker which enables compact and slim design by arranging, inside the microspeaker, a chamber for receiving rearward sound generated at the rear side of a vibration plate.

It is another object of the present invention to provide a microspeaker which can avoid being affected by a cable and soldering by arranging, in the microspeaker, a chamber for receiving rearward sound generated at the rear side of a vibration plate and improve quality of sound through precise control of the size of a chamber using acoustic resonance.

It is a further object of the present invention to provide a microspeaker which can remove shrill sound in the high frequency range by both minimizing the size of a chamber for damping rearward sound radiated from the rear side of the vibration plate and controlling the natural frequency in the high frequency range.

In accordance with an aspect of the present invention, the above and other objects can be accomplished by the provision of a microspeaker with an inner resonance chamber including a frame having open upper and lower portions, a magnetic unit installed in the frame and defining an air gap, and a vibration plate adapted to vertically vibrate according to action of a voice coil positioned in the gap, the microspeaker including a circuit board installed at a lower end of the frame, and an inner resonance chamber formed between the magnetic unit and the circuit board and defining a space with a certain size to receive a rearward sound generated at a rear side of the vibration plate.

The inner resonance chamber includes a first through hole penetrating the magnetic unit to guide the rearward sound generated at the vibration plate, and an inner chamber formed between the magnetic unit and the circuit board to receive the rearward sound discharged through the first through hole.

The circuit board is electrically connected with the voice coil to apply an external signal to the voice coil.

The circuit board is provided with a second through hole for discharging the rearward sound discharged from the inner chamber outside, the second through hole being formed to be smaller than the first through hole.

An inner surface of the frame is provided with an installation groove into which a lead wire for electrically connecting the circuit board with the voice coil is inserted.

The circuit board includes an upper circuit board contacting a lower surface of the magnetic unit, and a lower circuit board installed at a lower end of the frame and electrically connected with the upper circuit board, and the inner chamber is formed between the upper circuit board and the lower circuit board.

The microspeaker further includes a chamber case installed, in the frame, between the magnetic unit and the circuit board to support a lower end of the magnetic unit and define the inner chamber.

The chamber case has a shape of a cylinder with open upper and lower portions, and closely contacts an inner circumferential surface of the frame.

A protrusion adapted to protrude to support the magnetic unit and define the inner chamber with a certain size between the magnetic unit and the circuit board is integrally formed at the inner surface of the frame.

Damper plates are installed at the first through hole and the second through hole to block part of the rearward sound.

A resonant frequency of the inner chamber is controlled using a diameter and length of the first through hole and a diameter of the inner chamber.

In accordance with another aspect of the present invention, there is provided a microspeaker with an inner resonance chamber including a frame having open upper and lower portions, a vibration plate fixed to an upper end of the frame and having a voice coil fixed to a lower surface of the vibration plate, a magnetic unit including a magnet, an upper plate installed on an upper portion of the magnet, and a yoke member defining, between the yoke member and the magnet, an air gap in which the voice coil is positioned, a circuit board installed at a lower end of the frame to apply an external electric signal to the voice coil, a first through hole adapted to penetrate the yoke member to guide a rearward sound generated at the vibration plate, an inner chamber formed between the magnetic unit and the circuit board and adapted to receive the rearward sound discharged through the first through hole, and a second through hole formed in the circuit board.

The yoke member includes a yoke body for defining an air gap between the yoke body and the magnet, and a lower plate for supporting a lower end of the magnet, and the first through hole is formed to vertically penetrate the center of the yoke body.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
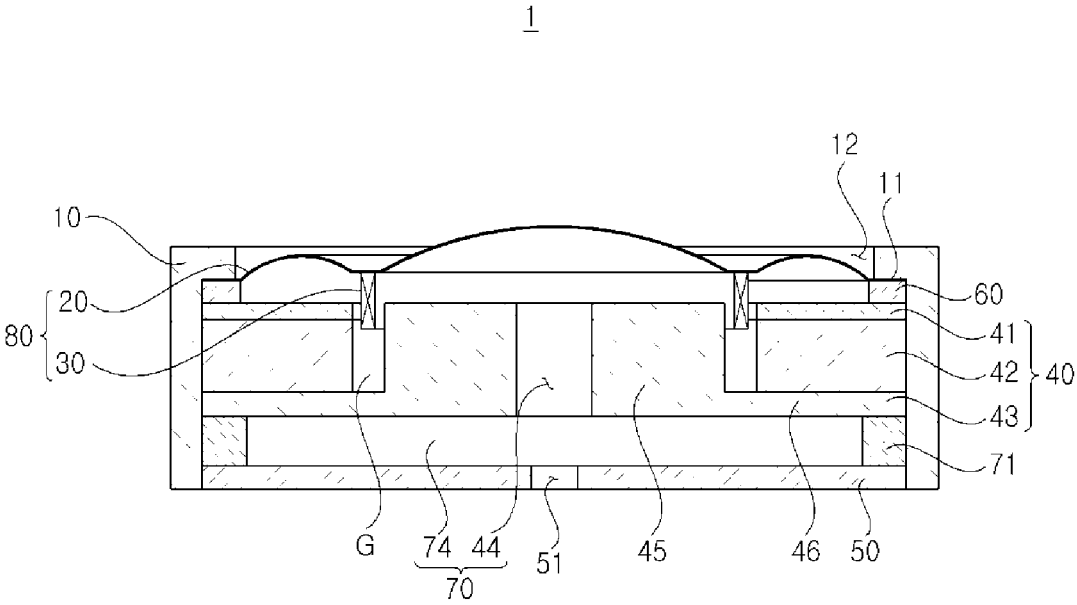
FIG. 1 is a cross-sectional view illustrating a microspeaker with an inner resonance chamber according to a first embodiment of the present invention.

Reference will now be made in detail to the embodiments of a microspeaker with an inner resonance chamber according to the present invention, examples of which are illustrated in the accompanying drawings.

It should be understood that the terms used in the specification and appended claims should not be construed as limited to general and dictionary meanings but should be construed based on the meanings and concepts according to the spirit of the present invention on the basis of the principle that the inventor is permitted to define appropriate terms for best explanation. The embodiments described in the specification and shown in the drawings are purely illustrative and are not intended to represent all aspects of the invention, such that various equivalents and modifications may be made without departing from the spirit of the invention.

Figure 2:
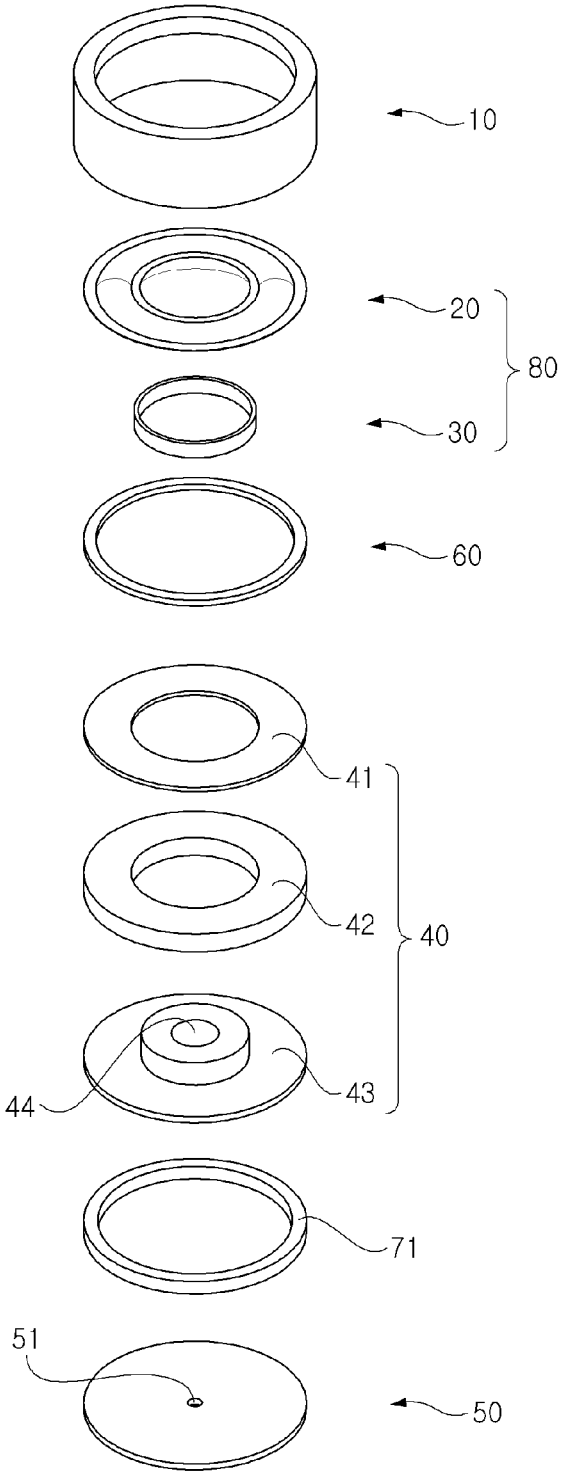
FIG. 2 is an exploded perspective view illustrating the microspeaker of FIG. 1.

As shown in FIGS. 1 and 2, a microspeaker 1 with an inner resonance chamber (hereinafter, referred to as a microspeaker) according to the present invention includes a frame 10 having open upper and lower portions, a vibration unit 80 including a vibration plate 20 fixed to the upper end of the frame 10 and a voice coil 30 attached to the lower surface of the vibration plate 20, an upper plate 41 positioned in the frame 10, a magnetic unit 40 including a magnet 42 and a yoke member 43, and a circuit board 50 installed at the lower end of the frame 10.

An "inner resonance chamber 70" is formed in the frame 10. The inner resonance chamber 70 includes a first through hole 44 formed in the magnetic unit 40, and an inner chamber 74 formed between the lower end of the magnetic unit 40 and the circuit board 50.

The inner resonance chamber 70 blocks the rearward sound generated at the rear side of the vibration plate 20 and at the same time allows the rearward sound to cause acoustic resonance. More specifically, the first through hole 44 guides the rearward sound generated at the vibration plate 20 to the inner chamber 74. The inner chamber 74 blocks the rearward sound emitted through the first through hole 44, and receives and damps the rearward sound. The first through hole 44 and the inner chamber 74 allow the rearward sound to cause acoustic resonance.

That is, in conventional cases, a chamber (back volume) has been installed in order to block or damp the rearward sound radiated from the rear side of the vibration plate 20. However, the conventional back volume has been installed outside the microspeaker, i.e., at the outside of the frame 10. On the other hand, in the present invention, the chamber is installed inside the frame 10. In view of the above, the chamber is referred to as an "inner chamber."

With reference to FIGS. 1 and 2, the frame 10 according to the present invention has a shape of a cylinder with open upper and lower portions. Preferably, the frame 10 is formed of a plastic injection molding product. A step 11 for installing the vibration plate 20 is formed at the upper end of the frame 10. Formed at the upper portion of the frame 10 is a forward sound emitting outlet 12 from which forward sounds generated at the front of the vibration plate 20 are radiated. Here, the forward sound emitting outlet 12 may be integrally formed in the frame 10, or formed in an upper cover or grille (not shown) installed at the upper end of the frame 10.

The edge of the vibration plate 20 is fixed to the frame 10. The voice coil 30 is fixed to the lower surface of the vibration plate 20. The magnetic unit 40 installed inside the frame 10 includes the magnet 42 having a ring shape, the upper plate 41 installed on the upper surface of the magnet 42, and the yoke member 43 installed within the magnet 42 to define an air gap G of a specific width. The yoke member 43 includes a yoke body 45 with a circular column shape positioned inside the magnet 42 to define the air gap G, and a lower plate 46 with a plate shape for supporting the lower surface of the magnet 42.

The first through hole 44 is formed at the center of the yoke body 45 to vertically penetrate the yoke body 45. The first through hole 44 is formed in the shape of a circular hole, and guides the rearward sound radiated from the rear side of the vibration plate 20 to the inner chamber 74.

The inner chamber 74 is arranged between the yoke member 43 and the circuit board 50. The circuit board 50 is fitted into the lower end of the frame 10 and attached to the inner side of the lower end of the frame 10. The circuit board 50, which is shaped in a flat plate, closely contacts the inner surface or lower end of the frame 10 so as to seal the lower end of the frame 10.

The circuit board 50 applies an external electric signal to the voice coil 30. In conventional microspeakers, a circuit board is installed at the outside thereof, i.e., at the outside of the frame, to apply an external electric signal to the voice coil. On the other hand, in the present invention, the circuit board 50 is integrally installed at the lower end of the frame 10 to define the inner chamber 74 between the magnetic unit 40 and the circuit board 50.

Since the circuit board 50 is installed at the lower end of the frame 10 and the inner chamber 74 is defined between the circuit board 50 and the magnetic unit 40 as described above, a slim and compact design of the microspeaker 1 is enabled.

The inner chamber 74 enhances the characteristics of a lower frequency sound by blocking the rearward sound to prevent interference with the forward sound and damping the rearward sound to allow the vibration plate 20 to normally vibrate. Also, the first through hole 44 and the inner chamber 74 function together as a resonance chamber which resonates with the vibration plate 10. Since the inner resonance chamber 70 does not have a cable or soldering therein, the size of the inner resonance chamber 70 can be precisely controlled.

When a natural frequency of an object coincides with the frequency of an external force, the amplitude of vibration increases. This phenomenon is referred to as resonance, and in particular referred to as "acoustic resonance" in the field of acoustics. That is, sound quality can be improved by precisely adjusting the size of an inner resonance chamber to make the natural frequency of the inner resonance chamber coincide with that of a vibration plate.

Figure 3:
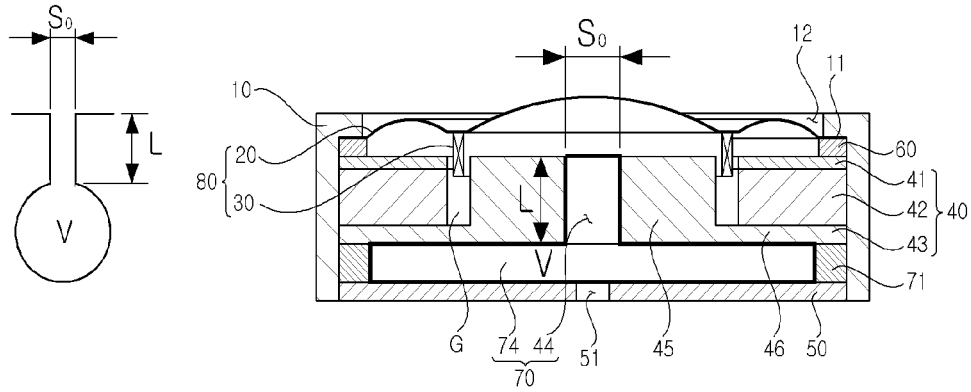
FIG. 3 is a cross-sectional view illustrating a comparison between the microspeaker of FIG. 1 and a Helmholtz resonator.

As shown in FIG. 3, the inner resonance chamber 70 of the present invention has a shape corresponding to a Helmholtz resonator shown on the left side of FIG. 3. That is, the Helmholtz resonator, which is a device configured with a sealed chamber having a small hole or mouth, is identical to the inner resonance chamber 70 having the first through hole 44 and the inner chamber 74. Therefore, by designing the size of the inner resonance chamber 70 to allow the inner resonance chamber 70 to have the natural frequency of the vibration plate 20, the rearward sound generated by the frame 10 can be made to cause acoustic resonance.

For example, the resonant frequency of the inner resonance chamber 70 can be found from the following equation for a Helmholtz resonator.

$$f_{Res} = \frac{C}{2\pi}\sqrt{\frac{S_0}{VL'}}$$

Here, L'=L+1.75a, and a is the radius of the neck, L is the length of the neck, $S_0$ is the area of the neck, and V is the volume of the resonator.

Figure 12:
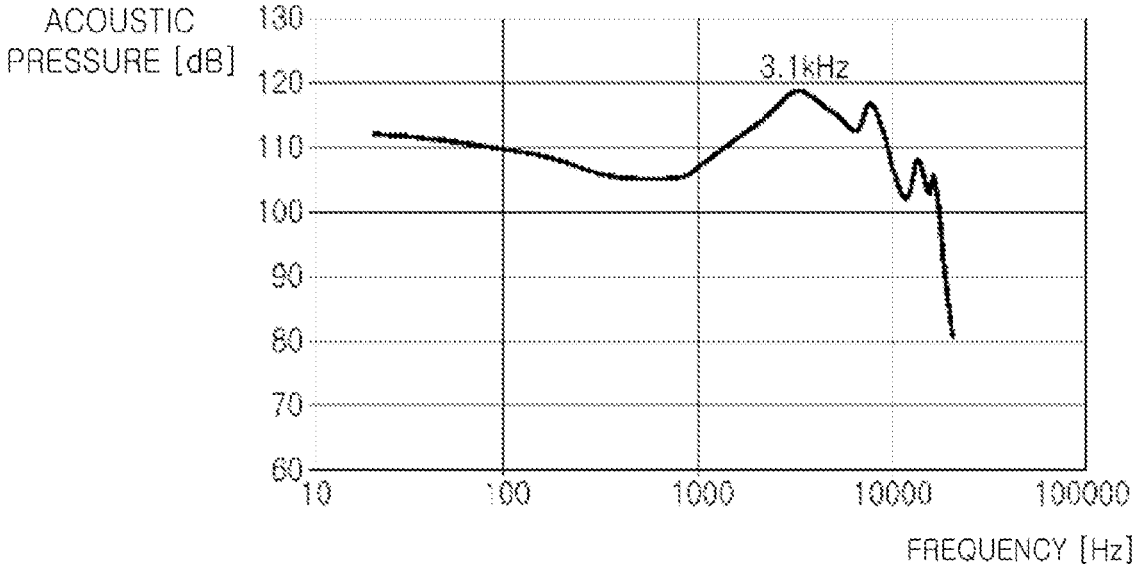
FIG. 12 is a graph showing the natural frequency of an inner resonance chamber according to the present invention.

That is, a resonant frequency can be estimated by using the radius and length of the first through hole 44 and the diameter of the inner chamber 74, the first through hole 44 and the inner chamber 74 constituting the inner resonance chamber 70. For example, if the radius of the first through hole 44 is 0.03 mm, the length of the first through hole 44 is 0.12 mm, the diameter of the inner chamber 74 is 0.4 mm, and the speed of sound (C) is 344 m/s, then the resonant frequency of the inner resonance chamber 70 is 3.1 kHz. Therefore, when the natural frequency of the vibration plate 20 is 3.1 kHz, a rearward sound generated at the rear side of the vibration plate 20 will cause acoustic resonance in the inner resonance chamber 70 (see FIG. 12).

Hereinafter, various examples for defining the inner chamber 74 according to the present invention will be described. With reference to FIGS. 1 and 2, the inner chamber 74 of the present invention may be defined by a chamber case 71 interposed between the yoke member 43 and the circuit board 50. That is, by installing the cylindrical chamber case 71 having the open upper and lower portions between the yoke member 43 and circuit board 50, the inner chamber 74 of a certain size is formed within the chamber case 71.

Figure 4:
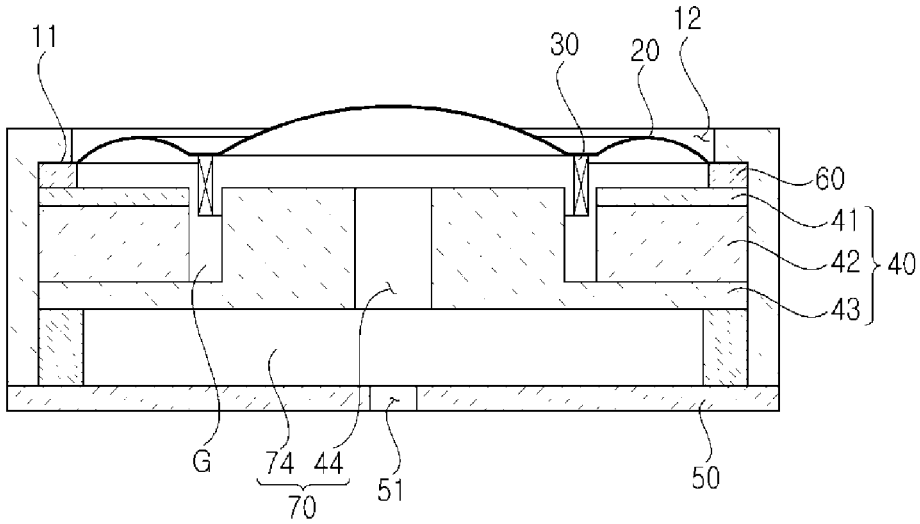
FIG. 4 is a cross-sectional view illustrating a microspeaker with an inner resonance chamber according to a second embodiment of the present invention.

The upper end of the chamber case 71 closely contacts the yoke member 43, while the lower end of the chamber case 71 closely contacts the circuit board 50. The circuit board 50 may be installed at the inner side of the frame 10, or attached to the lower ends of the frame 10 and chamber case 71, as shown in FIG. 4. If the circuit board 50 is attached to the lower end of the frame 10, the size of the inner chamber 74 can be maximized.

If the inner resonance chamber 70 is formed by the chamber case 71, the inner resonance chamber 70 of a constant size can be formed, leading to simplification of the manufacturing process. Further, since the yoke member 43 and the circuit board 50 are supported by the chamber case 71, they can be firmly fixed.

Figure 5:
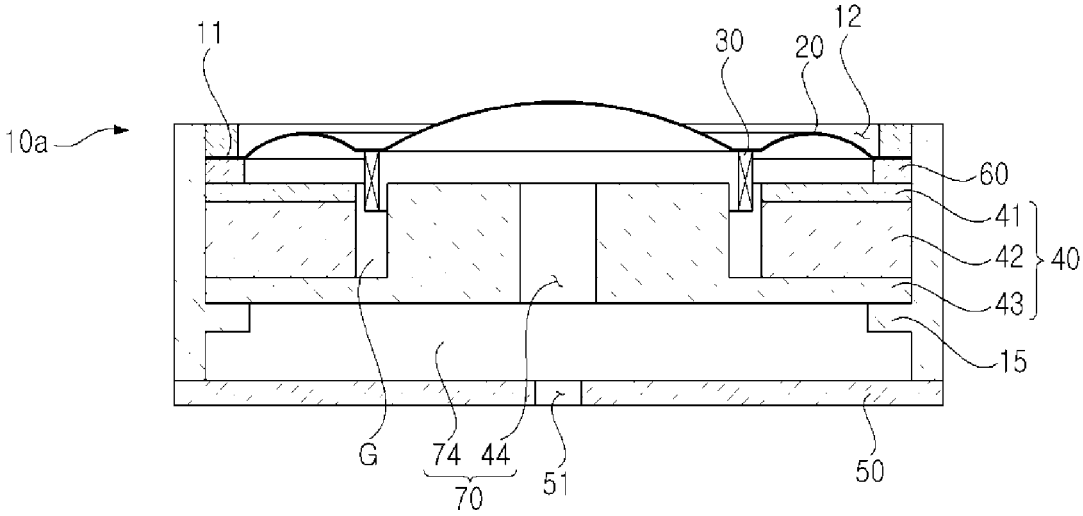
FIG. 5 is a cross-sectional view illustrating a microspeaker with an inner resonance chamber according to a third embodiment of the present invention.

Moreover, as shown in FIG. 5, the inner chamber 74 can be defined by a protrusion 15 formed on the frame 10*a*. That is, the inner chamber 74 of a certain size is formed between the yoke member 43 and the circuit board 50 by forming, on the inner surface of the frame 10*a*, the protrusion 15 protruding inward and installing the yoke member 43 on the upper surface of the protrusion 15. Using the protrusion 15 formed on the frame 10 as above may complicate the process of manufacturing the frame 10, but it can facilitate the installation of the magnetic unit 40 and increase the volume of the inner chamber 74 by the thickness of the chamber case 71 which is eliminated.

Meanwhile, as shown in FIGS. 1 to 5, the circuit board 50 may be provided with a second through hole 51. The second through hole 51 discharges part of the rearward sound of the inner chamber 74 outside to prevent increase of pressure in the inner chamber 74. Here, to minimize interference of the rearward sound with the forward sound, it is preferred to form the second through hole 51 to have a smaller area than the first through hole 44.

Figure 6:
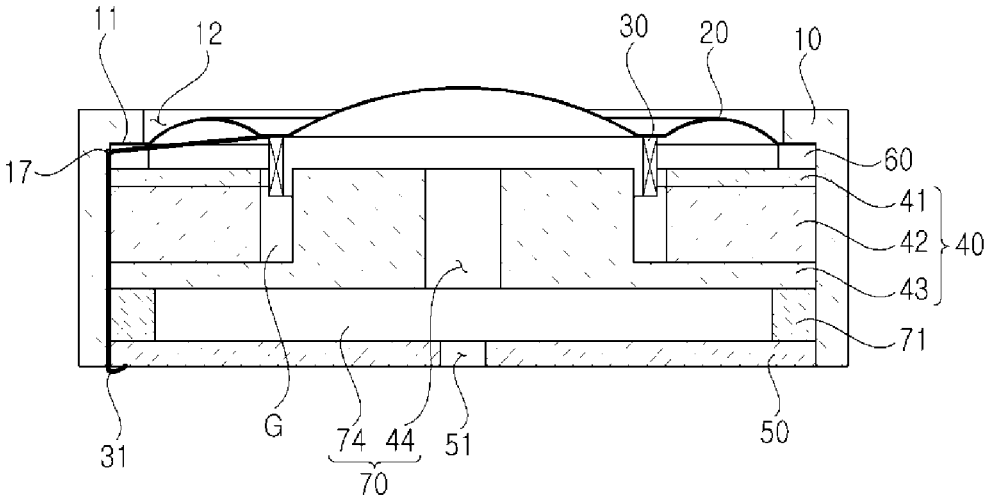
FIG. 6 is an exploded perspective view illustrating connection of a voice coil through a groove defined in a frame according to the present invention.
Figure 7:
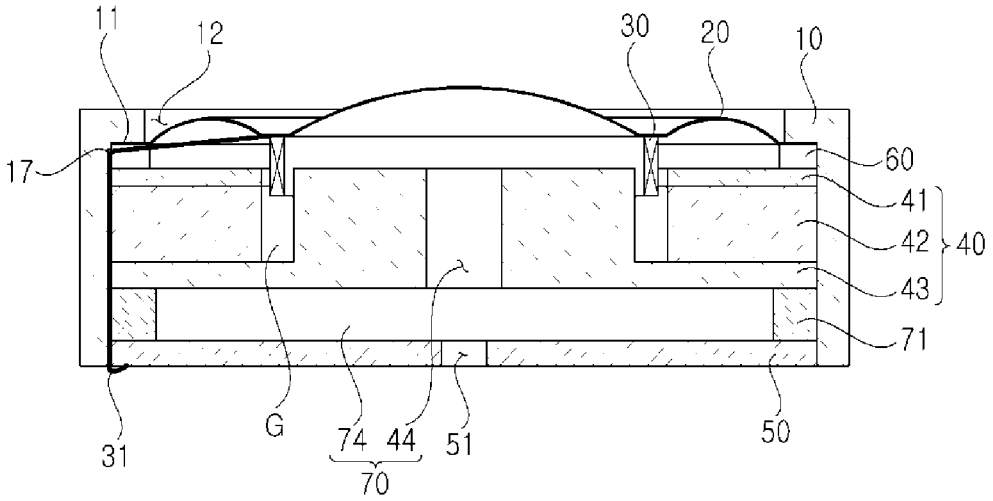
FIG. 7 is a cross-sectional view illustrating connection of a lead wire of the voice coil according to the present invention.

As shown in FIGS. 6 and 7, an installation groove 17 penetrated by a lead wire 31 is formed on the inner surface of the frame 10. The lead wire 31, which is an electric cable for electrically connecting the voice coil 30 and the circuit board 50, is connected to the lower surface of the circuit board 50 through the installation groove 14 vertically formed on the inner surface of the frame 10. Another groove penetrated by the lead wire 31 may be formed on the circuit board 50 and a ring member 60, if necessary. The ring member 60 is used to fix the vibration plate 20. By inserting the lead wire 31 into the installation groove 17 formed on the inner surface of the frame 10 as above, the lead wire 31 can be prevented from protruding into the inner chamber 74 and the installation of the chamber case 71 can be facilitated.

Figure 8:
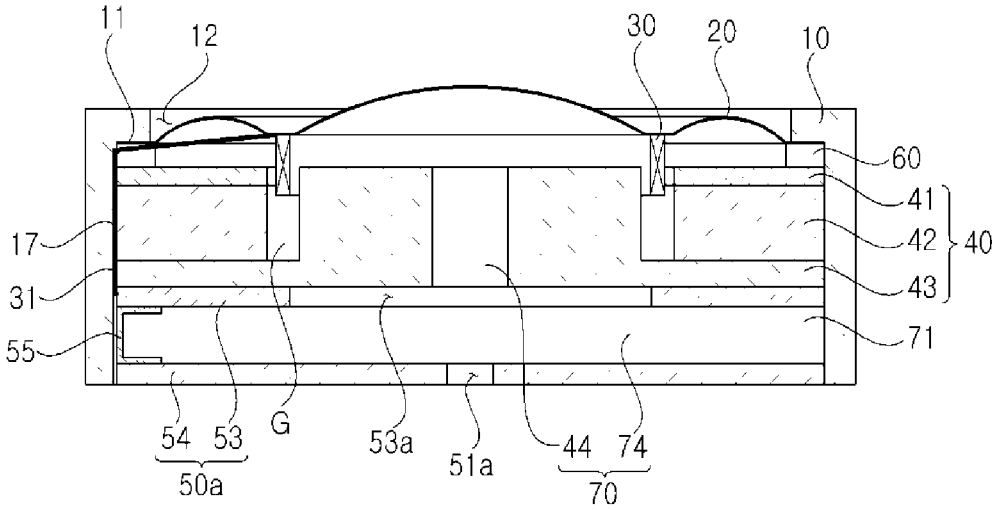
FIG. 8 is a cross-sectional view illustrating a microspeaker with an inner resonance chamber according to a fourth embodiment of the present invention.

FIG. 8 is a cross-sectional view illustrating a microspeaker with an inner resonance chamber according to another embodiment of the present invention. As shown in FIG. 8, a circuit board 50*a* of the present invention includes an upper circuit board 53 and a lower circuit board 54. The upper circuit board 53 contacts the bottom surface of the yoke member 43, and the lower circuit board 54 is fixed to the lower end of the frame 10. Thereby, the inner chamber 74 of a constant size is formed between the upper circuit board 53 and lower circuit board 54.

Rigid printed circuit boards or flexible printed circuit boards (FPCBs) may be used as the upper circuit board 53 and lower circuit board 54. The upper circuit board 53 and the lower circuit board 54 are electrically connected by a connection member 55. The connection member 55 is configured with an FPCB. The connection member 55 configured with the FPCB can prevent diffuse reflection of a sound and facilitate wiring. A third through hole 53*a* having a larger diameter than the first through hole 44 is formed in the upper circuit board 53. A second through hole 51*a* is formed in the lower circuit board 54.

Figure 9:
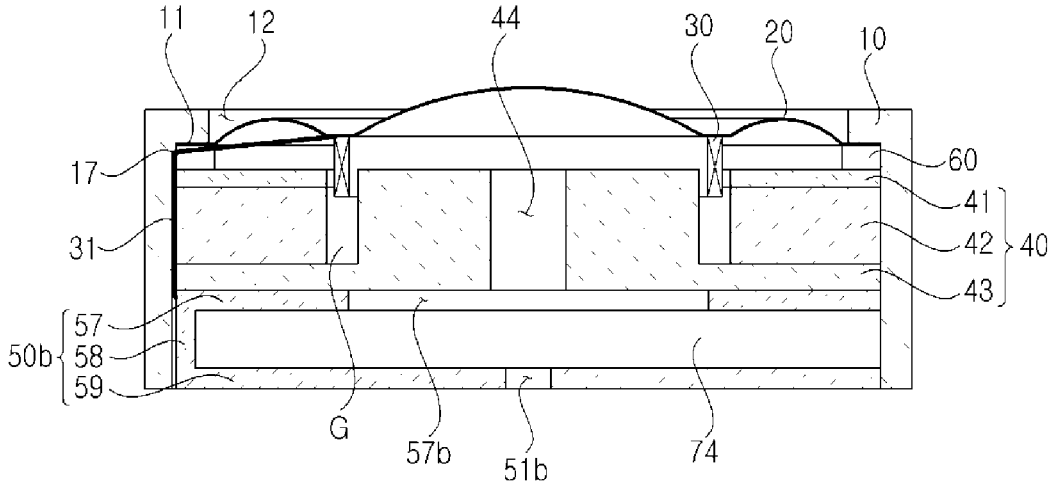
FIG. 9 is a cross-sectional view illustrating a microspeaker with an inner resonance chamber according to a fifth embodiment of the present invention.

Next, FIG. 9 shows a microspeaker with an inner resonance chamber according to another embodiment of the present invention. As shown in FIG. 9, a circuit board 50*b* of the present invention includes an upper circuit board portion 57 attached to the bottom surface of the yoke member 43, a lower circuit board portion 59 attached to the lower end of the frame 10, and a connector 58 electrically connecting the upper circuit board portion 57 and connector 58. The inner chamber 74 is formed between the upper circuit board portion 57 and the lower circuit board portion 59. In the illustrated embodiment, as one FPCB forms the circuit board 50*b*, the structure of the microspeaker is simplified. A third through hole 57*b* having a larger diameter than the first through hole 44 is formed in the upper circuit board portion 57, and a second through hole 51*b* is formed in the lower circuit board portion 59.

Figure 10:
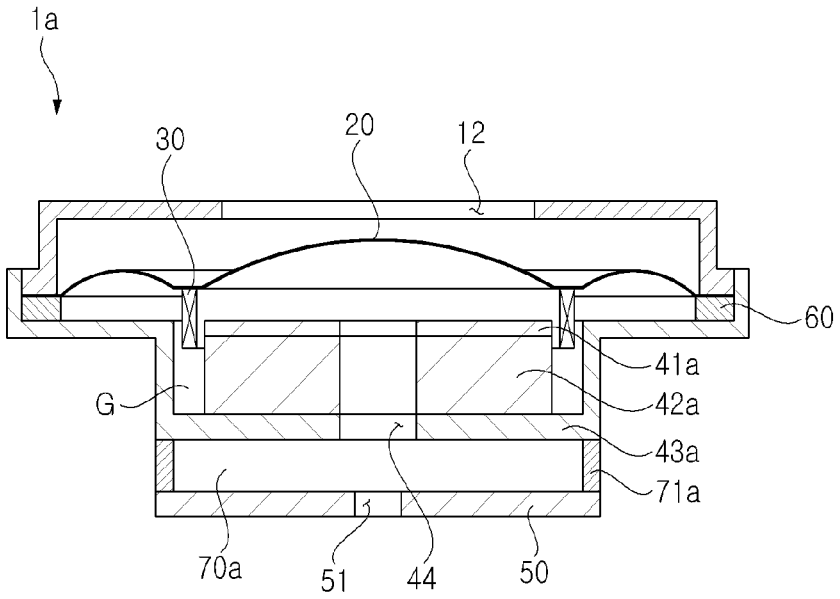
FIG. 10 is a cross-sectional view illustrating a microspeaker with an inner resonance chamber according to a sixth embodiment of the present invention.

FIG. 10 shows a microspeaker with an inner resonance chamber according to a further embodiment of the present invention. As shown in FIG. 10, a separate chamber case 71*a* is attached to the lower surface of the microspeaker, and the circuit board 50 is attached to the lower end of the chamber case 71*a*. Accordingly, a space of a specific size is provided in the chamber case 71*a*, and the circuit board 50 is electrically connected with voice coil 30. In the illustrated embodiment, the first through hole 44 is defined at the center of the magnet 42*a* and lower plate 43*a*.

Figure 11:
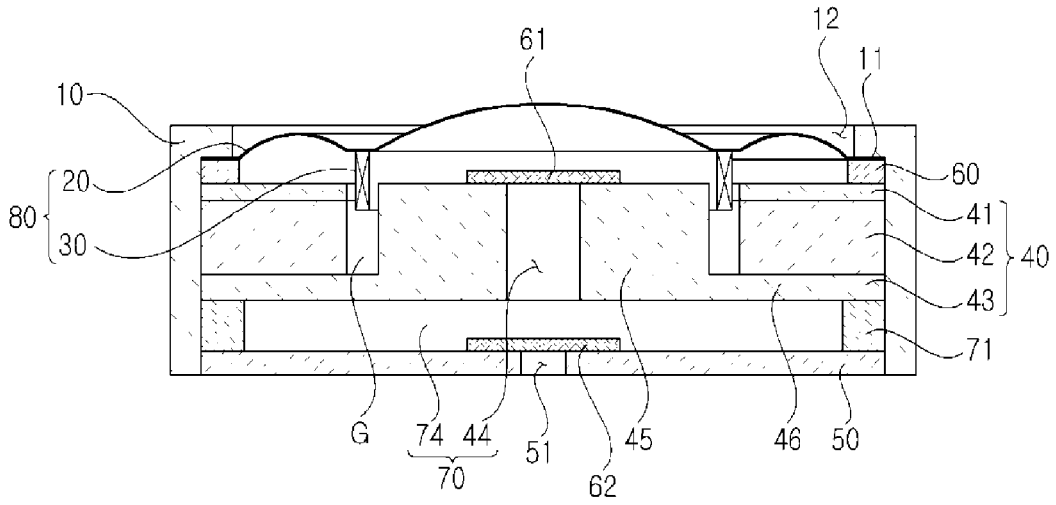
FIG. 11 is a cross-sectional view illustrating a microspeaker with an inner resonance chamber according to a seventh embodiment of the present invention.

Meanwhile, as shown in FIG. 11, damper plates 61 and 62 may be installed at the first through hole 44 and second through hole 51 of a microspeaker with an inner resonance chamber according to the present invention. The damper plates 61 and 62 serve to block or damp part of the rearward sound. Preferably, the damper plates 61 and 62 may be formed in the shape of a mesh. More preferably, the damper plates 61 and 62 may be formed of cloth with the shape of a mesh.

The damper plates 61 and 62 block part of the rearward sound generated at the rear side of the vibration plate 20 to keep sound pressure at the rear side constant. That is, if the rearward sound generated at the rear side of the vibration plate 20 is allowed to be discharged through the first through hole 44 and second through hole 51, the amplitude of vibration of the vibration plate 20 could be excessively increased, resulting in an impulse sound. That is, the impulse sound is generated when the vibration plate 20 vibrates excessively and strikes the upper plate 41.

Therefore, the damper plates 61 and 62 serve to block part of the rearward sound discharged through the first through hole 44 and second through hole 51 to repress the amplitude of vibration of the vibration plate 20. The damper plates 61 and 62 also serve to change the natural frequency of the vibration plate 20. That is, in order to cause acoustic resonance, the resonant frequency can be found by precisely controlling the size of the inner resonance chamber 70 and using various kinds of damper plates 61 and 62.

Figure 13:
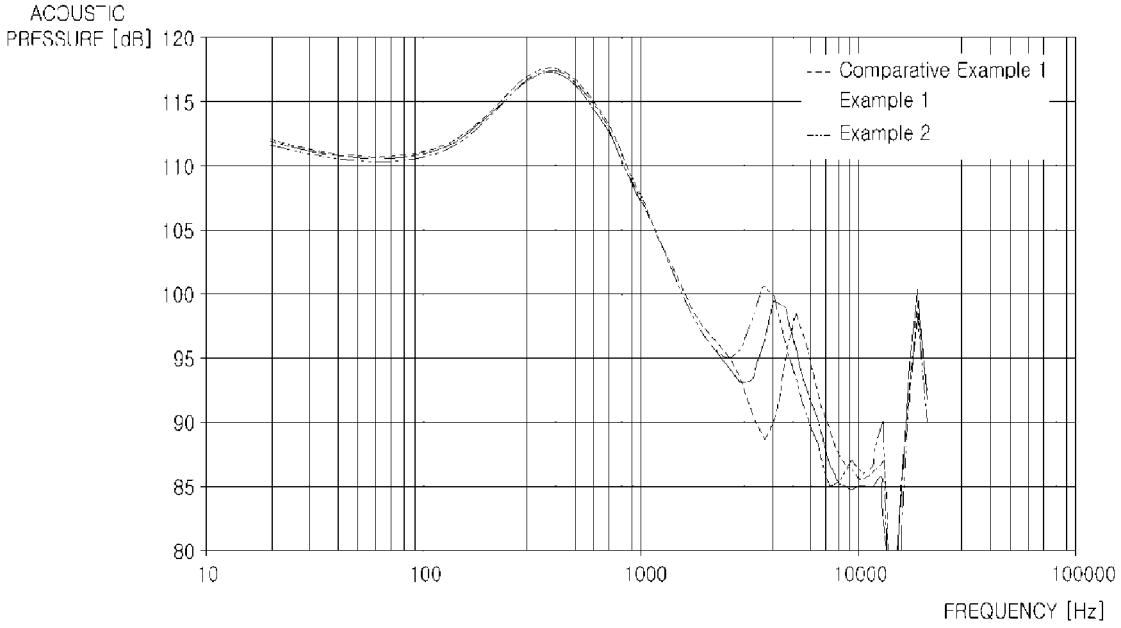
FIG. 13 is a graph showing performances of microspeakers of Examples 1 and 2 and Comparative Example 1 that were measured and recorded.

Hereinafter, effects of a microspeaker with an inner resonance chamber according to the present invention will be described with reference to the accompanied graphs. As shown in FIG. 13, compared to Comparative Example 1 without an inner resonance chamber, Examples 1 and 2 provided with an inner resonance chamber have a resonant frequency shifted from a high frequency band to a lower frequency band.

In Example 1, the inner resonance chamber 70 having a volume of 0.02 cc is formed between the magnetic unit 40 and the circuit board 50 by using the chamber case 71. The effective area of the vibration plate 20 is 65 mm, and the weight of the voice coil 30 is 1.5 mg. Example 2 has the same conditions as Example 1, except that the inner resonance chamber 70 has a larger volume of 0.04 cc. Comparative Example 1 has the same conditions as Example 1, except that the inner resonance chamber 70 is not provided.

As shown in FIG. 13, it can be seen that as the volume of the inner resonance chamber 70 increases from 0 cc to 0.02 cc and to 0.04 cc, the sound pressure at the resonant frequency in the high frequency band increases. As such, when the sound pressure increases along with shift of the resonant frequency from the higher frequency band to the lower frequency band, the shrill sound occurring in the high frequency band can be eliminated and high quality sound having a clear tone can be realized by increasing the sound pressure in the high frequency band.

Figure 14:
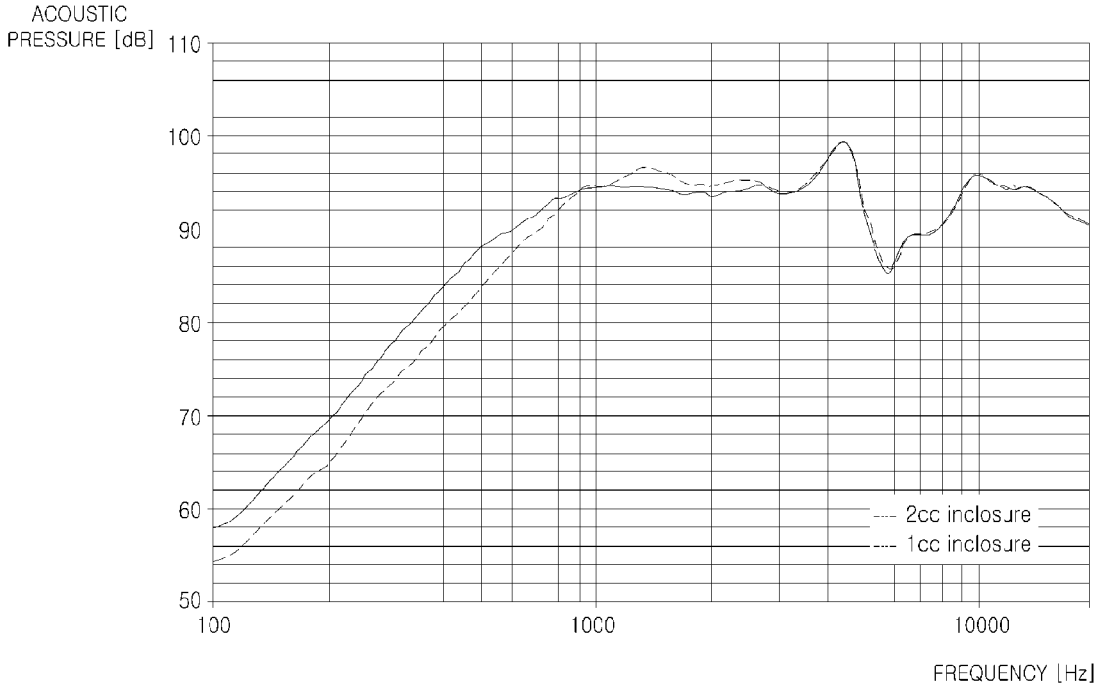
FIG. 14 is a graph showing performance of a conventional microspeaker for Comparative Examples 2 and 3 that was measured and recorded.
Figure 15:
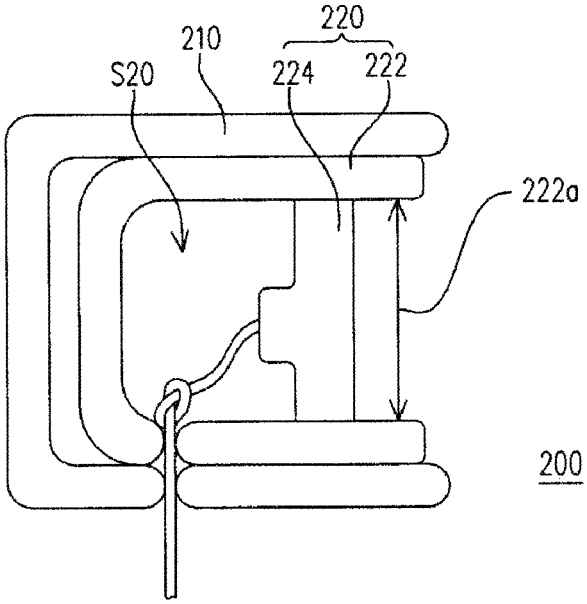
PRIOR ART FIG. 15
FIG. 15 is a cross-sectional view illustrating the structure of the conventional microspeaker.

FIG. 14 is a graph showing performance of a conventional microspeaker. It can be seen that when the volumetric size of the back volume within the enclosure of the conventional microspeaker changed from 1 cc (Comparative Example 1) to 2 cc (Comparative Example 2), the sound pressure increased in the low frequency band. That is, it can be see that if a back volume is formed outside the microspeaker according to the prior art, the characteristics of low frequency sounds in the low frequency band are improved, but the characteristics in the high frequency band hardly change.

Therefore, it can be seen that in order to generate a sound close to the original sound through adjustment of the acoustic balance in the high frequency band, it is needed to block the rearward sound generated at the rear side of the vibration plate and make the frequency of the vibration plate coincide with that of the chamber (back volume) to cause acoustic resonance.

As such, the present invention not only enables compact and slim design by arranging, inside a microspeaker, a chamber for blocking the rearward sound generated at the rear side of the vibration plate, but also can remove shrill sound in the high frequency range and realize high quality sound with a clear tone by precisely controlling the size of the inner resonance chamber and installing damper plates at the first and second through holes to shift the resonant frequency from the high frequency band to the lower frequency band.

As is apparent from the above description, the present invention provides a microspeaker with an inner resonance chamber which enables slim and compact design of the microspeaker by installing a chamber for accommodating the rearward sound generated at the rear side of a vibration plate at the inside of the microspeaker, rather than at the outside thereof.

In addition, since a cable or a foreign material such as solder is not present in the inner chamber and the size thereof can be controlled to be uniform for products, the quality of sound can be improved by setting the natural frequency of the vibration plate to coincide with that of the inner resonance chamber.

Particularly, since the present invention uses an inner chamber with a relatively small space to accommodate the rearward sound, not only compact and slim design of a microspeaker is enabled, but also shrill sound can be removed by shifting the resonant frequency in the higher frequency band to the lower frequency band.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microspeaker comprising: an inner resonance chamber including a frame having open upper and lower portions; a magnetic unit installed in the frame and defining an air gap; a vibration plate configured to vertically vibrate according to action of a voice coil positioned in the gap; a circuit board installed at a lower end of the frame; and an inner resonance chamber formed between the magnetic unit and the circuit board and defining a space with a certain size to receive a rearward sound generated at a rear side of the vibration plate; wherein the inner resonance chamber comprises a first through hole penetrating the magnetic unit to guide the rearward sound generated at the vibration plate, and an inner chamber formed between the magnetic unit and the circuit board to receive the rearward sound discharged through the first through hole.

2. The microspeaker according to claim 1, wherein the circuit board is electrically connected with the voice coil to apply an external signal to the voice coil.

3. The microspeaker according to claim 2, wherein the circuit board is provided with a second through hole for discharging the rearward sound discharged from the inner chamber outside, the second through hole being formed to be smaller than the first through hole.

4. The microspeaker according to claim 3, wherein an inner surface of the frame is provided with an installation groove into which a lead wire for electrically connecting the circuit board with the voice coil is inserted.

5. The microspeaker according to claim 4, further comprising a chamber case installed, in the frame, between the magnetic unit and the circuit board to support a lower end of the magnetic unit and define the inner chamber.

6. The microspeaker according to claim 5, wherein the chamber case has a shape of a cylinder with open upper and lower portions, and closely contacts an inner circumferential surface of the frame.

7. The microspeaker according to claim 4, wherein a protrusion adapted to protrude to support the magnetic unit and define the inner chamber with a certain size between the magnetic unit and the circuit board is integrally formed at the inner surface of the frame.

8. The microspeaker according to claim 4, wherein damper plates are installed at the first through hole and the second through hole to block part of the rearward sound.

9. The microspeaker according to claim 4, wherein a resonant frequency of the inner chamber is controlled using a diameter and length of the first through hole and a diameter of the inner chamber.

10. The microspeaker according to claim 3, wherein the circuit board includes an upper circuit board contacting a lower surface of the magnetic unit, and a lower circuit board installed at a lower end of the frame and electrically connected with the upper circuit board, and the inner chamber is formed between the upper circuit board and the lower circuit board.

11. A microspeaker with an inner resonance chamber, the microspeaker comprising:

a frame having open upper and lower portions;

a vibration plate fixed to an upper end of the frame and having a voice coil fixed to a lower surface of the vibration plate;

a magnetic unit including a magnet, an upper plate installed on an upper portion of the magnet, and a yoke member defining, between the yoke member and the magnet, an air gap in which the voice coil is positioned;

a circuit board installed at a lower end of the frame to apply an external electric signal to the voice coil;

a first through hole adapted to penetrate the yoke member to guide a rearward sound generated at the vibration plate;

an inner chamber formed between the magnetic unit and the circuit board and adapted to receive the rearward sound discharged through the first through hole; and a second through hole formed in the circuit board.

12. The microspeaker according to claim 11, wherein the yoke member includes a yoke body for defining an air gap between the yoke body and the magnet, and a lower plate for supporting a lower end of the magnet, and the first through hole is formed to vertically penetrate the center of the yoke body.

* * * * *